United States Patent [19]

Garrison

[11] 4,187,967

[45] Feb. 12, 1980

[54] SWIVEL HOOK ATTACHMENT FOR ARTICLE HANGERS

[75] Inventor: Judd F. Garrison, Grand Rapids, Mich.

[73] Assignee: John Thomas Batts, Inc., Zeeland, Mich.

[21] Appl. No.: 913,841

[22] Filed: Jun. 8, 1978

[51] Int. Cl.[2] ..... A47J 51/098

[52] U.S. Cl. ..... 223/92

[58] Field of Search ..... 223/85, 88, 91, 92, 223/93, 94, 95, 96; 211/113, 115

[56] References Cited

U.S. PATENT DOCUMENTS

| | | | |
|---|---|---|---|
| 2,460,438 | 2/1949 | Treiman | 223/92 |
| 3,319,850 | 5/1967 | Rosen | 223/92 |
| 3,407,979 | 10/1968 | Patch | 223/98 |
| 3,790,044 | 2/1974 | Verdile | 223/88 |
| 4,074,838 | 2/1978 | Blasnik et al. | 223/85 |

*Primary Examiner*—George H. Krizmanich
*Attorney, Agent, or Firm*—Price, Heneveld, Huizenga & Cooper

[57] ABSTRACT

A garment hanger is disclosed which has a molded plastic body to which a separate, preferably metal, hook is attached after the molding is complete. The molded body has a locking collar molded integrally with it but attached by a weak, rupturable web or stem. When the hook is assembled to the body, its shank is forced through the collar so that the collar becomes firmly secured to the shank and thereafter prevents separation of the hook and body. In one form of the invention, the forcing of the shank through the collar detaches it from the body, permitting the collar and hook to rotate freely with respect to the hanger body. In another form, the attachment between the hook and body remain intact until a subsequent maneuver is performed to cause separation of hook and hanger body.

22 Claims, 6 Drawing Figures

SWIVEL HOOK ATTACHMENT FOR ARTICLE HANGERS

FIELD OF THE INVENTION

This invention relates to hangers and particularly to garment hangers as used in either the men's or women's garment industry. The invention is directed to the means by which a separately fabricated hook can be secured to a garment hanger with a minimum of labor. It also makes it possible for the first time to provide a hanger having a swivel hook which may be assembled from only two components, the hook and the molded hanger body, without special tools and without special jigs.

BACKGROUND OF THE INVENTION

Hangers assembled from a molded plastic body and a separate hook have been long used in the garment industry. Such hangers have either been characterized by the hook being rigidly secured to the body whereby no rotation of the body with respect to the hook is possible or the separate hooks have been secured to the hanger body in such a manner that the hanger body may pivot around the hook but this has required either the assembly of several parts such as the hook, the hanger body and a separate locking collar or it has required the use of special tools to offset or reshape the shank of the hook after assembly of the hook to the hanger body. Either solution has been relatively expensive and labor intensive. Further, neither solution has been suitable for situations in which it is desirable to ship the hangers and bodies as separate pieces such as to a retail user because such users are not equipped to make the assembly.

BRIEF DESCRIPTION OF THE INVENTION

A molded body for the garment hanger is provided, the body having a hook-receiving opening extending vertically into the body from the top. The body has a front-to-back aperture which intersects this opening. Within the aperture, a collar or ring is molded integral with the hanger body and is connected to the hanger body only by one or more very thin, rupturable strands or stems of plastic. This collar is centered about the opening for the hook and itself has a hole to receive the shank of the hook so that when the hook is assembled to the hanger body, its shank is press-fitted through this collar, causing the collar to have a tight, interference fit with the shank. In one form of the invention, the force used to assemble the two parts is great enough that the connecting stem or thread is broken automatically, thus the collar is free to rotate with respect to the body. In another form of the invention, the rupture does not occur during assembly, requiring subsequent maneuver to free the hook for rotation. Thus, a hanger having a rotatable hook is created which is assembled without special tools and from only two components, the molded plastic hanger body and the hook.

BRIEF DESCRIPTION OF THE PREFERRED EMBODIMENT

Figure 1:
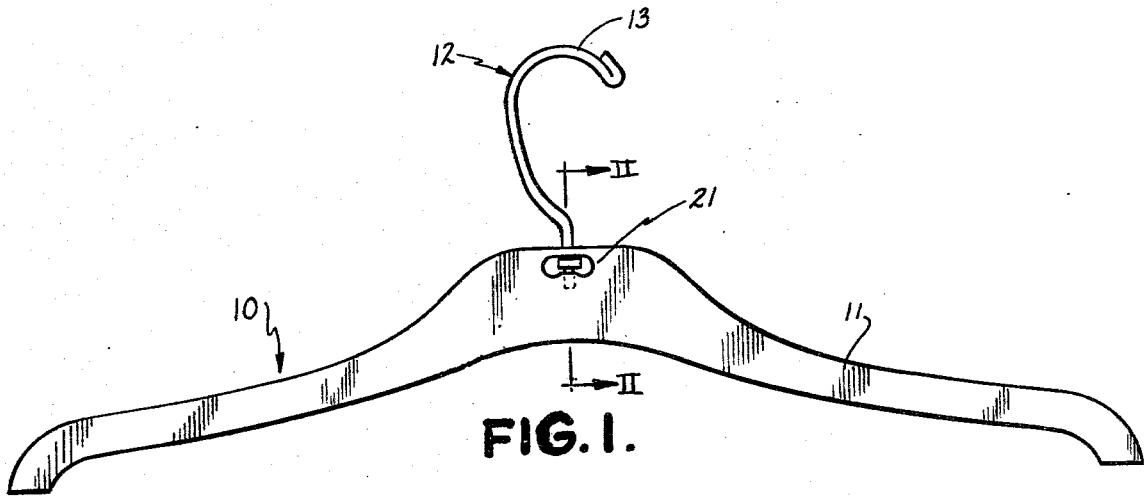
FIG. 1 is a side, elevation view of an assembled hanger incorporating this invention.

In FIG. 1, a conventional garment hanger 10 is illustrated. The hanger has a molded plastic body 11 and a supporting hook 12. The hanger body 11 is preferably molded from any one of the several plastics commonly used for garment hangers such as polystyrene or polypropylene. The particular style, shape or size of the hanger body is irrelevant to this invention so long as the body is one made from a molded plastic material. The hook 12 also is basically conventional except for the ribbing or projections which are provided in its shank portion which will be described later. The hook 12 has a standard, curved, support engaging upper portion 13 and a shank portion 14.

Figure 2:
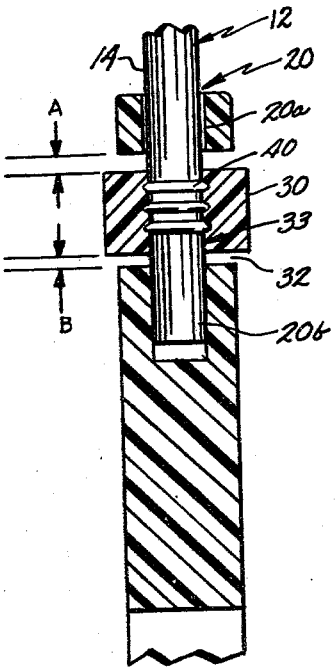
FIG. 2 is an enlarged, fragmentary, sectional, elevation view taken along the plane II—II of FIG. 1.
Figure 3:
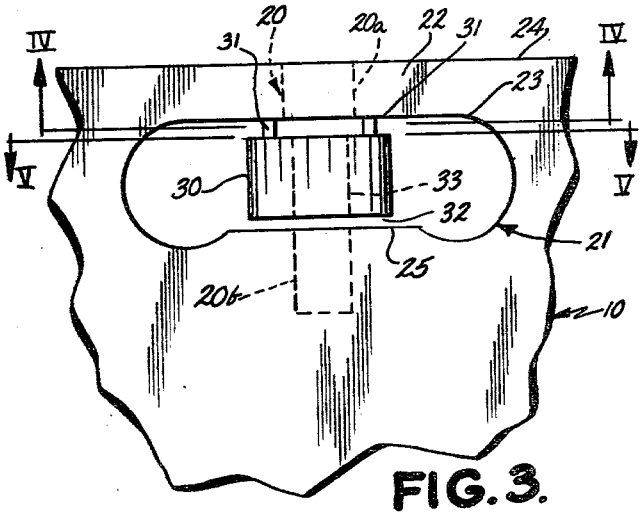
FIG. 3 is an enlarged, fragmentary, side elevation view of the hanger body as molded.
Figure 4:
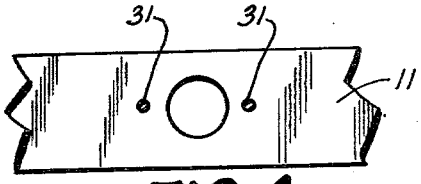
FIG. 4 is a fragmentary, sectional view taken along the plane IV—IV of FIG. 3.

As illustrated, the hanger body 11 is molded with a vertically extending hook-receiving opening 20 (FIG. 2). The opening 20 extends vertically into the hanger body from the top of the hanger and preferably is located at the center of the hanger or at least at the center of load when the hanger is loaded. The hanger body is also molded with an aperture 21 extending from the front face to the back face through the body of the hanger and centered about and intersecting the hook-receiving opening 20. The aperture 21 is spaced a distance below the top of the hanger to form a bridge 22 integral with the hanger body between the top wall 23 of the aperture 21 and the top surface 24 of the hanger (FIG. 3). The aperture 21 intersects the hook-receiving opening 20 dividing this opening into an upper portion **20*a* and a lower portion 20*b* (FIG. 2). The lower portion 20*b* extends from the lower wall 25 of the aperture down into the body 11** of the hanger, which lower portion of the body forms a lower or second bridge.

Located within the aperture 21 is the anchor ring or collar 30. This collar is centered about the hook 12 and as the hanger body 11 is originally molded, it is integral with the hanger body, being connected by a pair of thread-like stems 31. These stems 31 constitute a nexus by which the collar 30 is positively connected to the hanger body as the same is molded. These stems 31 are of such small diameter that they are readily rupturable to detach the collar 31 from the hanger body itself. The collar 30 is narrower than the aperture 21 in the vertical direction whereby, as the hanger body is originally molded, there is a gap 32 between the lower face or bottom of the collar and the bottom wall 25 of the aperture 21.

The collar 30 has a central opening 33 which is smaller in diameter than the upper portion **20*a* of the hook opening. To permit the mold core forming the opening 20 to be withdrawn without hang-up, the lower portion 20*b* of the opening 20 is of the same diameter as the opening 33 in the collar and, thus, is smaller in diameter than the upper portion 20*a*** of the opening.

While the hook 12 need not necessarily be fabricated from metal, this is a preferred material because it has the strength and resistance to deflection under load that its cross-sectional diameter can be small, yet adequate. It is conventional practice in the garment hanger industry to manufacture the hook from steel wire. The shank 14 of the hook is straight. A short distance above the lower end of the hook, the shank, before assembly to the hanger body, is processed in a manner to form ridges in its outer surface. This can be done in any of several ways, but preferably the most expedient is a rolling process which forms annular ribs 40. A knurling process which forms a rough textured surface or a deforming process creating radially extending ears may also be used. In these processes, the metal of the shank is squeezed under pressure, causing it to be reduced in cross-section in one area and the displaced metal to form an area of expanded cross-section in another. Thus, the ridges or the points of the knurling project radially outwardly further than the normal surface of the shank. Other processes can be applied which will accomplish basically the same result.

The diameter of the upper portion 20*a* of the hook-receiving opening 20 is large enough to allow the knurled or rolled area of the shank 14 to pass through it without interference. However, the opening in the center of the collar is somewhat smaller but still is sufficient to allow the untreated shank to pass through it and into the lower portion 20*b* of the opening. However, it is too small to pass the knurled or ridged area on the shank. Thus, as the hook is rammed or pressed through the collar 30, the knurling or ridges penetrate the side walls of the opening 33 and become physically embedded in the plastic of the collar. This locks the collar 30 to the shank of the hook by a tight interference fit. At the same time, the force used to push the shank of the hook through the collar 30 exceeds that which the stems can support and thus the stems 31 are ruptured, freeing the collar from the body of the hanger. Since the free or lead end of the hook shank has already passed through the collar and into the lower portion 20*b* of the opening before the ridges engage the collar and the stems 31 are ruptured the collar is positively held by the hook and cannot be lost. Since the shank 14 of the hook is of a diameter with respect to both the upper and lower hook-receiving portions of the opening 20 that it may freely turn with respect to the hanger body 11 and the collar 30 has been separated from the body 11, the assembled hook can be freely turned with respect to the body. At the same time, the positive, interference engagement between the ridges or knurling on the shank with the inner walls of the opening 33 of the collar 30 is sufficient that the collar will not slip lengthwise of the shank 14 even though the weight of the hanger plus the entire weight of the load that is imposed upon the hanger body will thereafter be transmitted from the hanger to the hook 12 through the collar 30. It is obvious at this point that the bridge 22 must be of sufficient thickness that it too can support this type of a load without deflection or failure.

Figure 5:
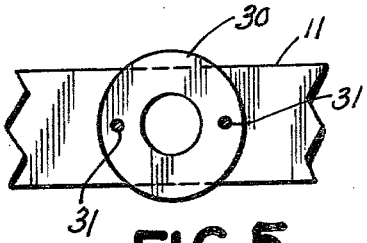
FIG. 5 is a sectional view taken along the plane V—V of FIG. 3.

It will be recognized that while the collar has been illustrated as circular, it is not to be limited to this shape, any other shape being suitable, so long as its size and shape permit it to freely rotate within the aperture 21, once it has been severed from the hanger body 11. It is also conceivable to make the collar of such a shape that the hook would be partially rotatable, i.e. always oriented in the same direction but rotated $\pm 15°$. As illustrated in FIGS. 2 and 5, the outer diameter of the collar is greater than the thickness of the hanger. Whether this condition is maintained depends upon the type of hanger involved. If the front-to-back wall thickness of the hanger is thin because the expected loads are light, it is necessary that the collar be thicker than the hanger to provide a sufficient wall thickness that it will not break under the radial forces imposed when the shank of the hook is inserted. It will also be understood that instead of the stems 31, a very thin annulus of plastic surrounding the opening 20 could be used to secure the collar to the hanger body as molded. It is important that if an annulus of this type is used, that the inside diameter be the same as that of the upper portion 20*a* of the opening 20 to permit the lead or bottom end of the shank of the hook to pass through it freely during assembly.

Figure 6:
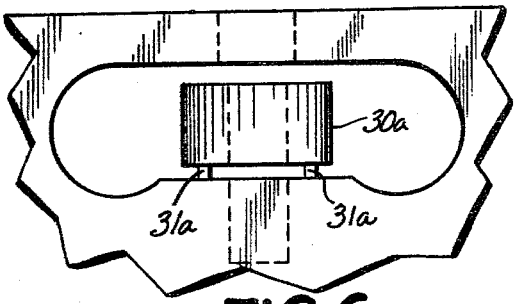
FIG. 6 is a view similar to FIG. 3 illustrating a modified form of the invention.

FIG. 6 illustrates a modification which is designed to eliminate the automatic severance of the collar from the hanger body when the hook is installed. In this modification, the connecting stems 31*a* are on the bottom side of the collar 30*a* and connect the collar to the bottom wall 25*a* of the aperture. All other structure of the hanger, hook and collar are the same as that illustrated in FIGS. 1–5.

In this construction, the forces generated in the assembly of the hook are imposed as compression on the stems 31*a* and thus will not rupture them during hook installation. When it is desired to separate the collar 30*a* from the hanger body 11*a*, the hook is forcibly rotated. This particular construction is useful when it is desired to assemble the hook and hanger body but retain the hook in a fixed relationship to the hanger body until a later time. An example of such a use would be assembly of the hooks and hanger bodies with the upper portions of the hooks in the same plane as the hanger bodies and then attach the hangers to the garment for shipment. The hangers will positively lay flat until the garments are received by the customer who will twist the hooks as the garments are unpacked so the hanger bodies and garments can pivot for display.

The invention provides a unitary hanger body and means for securing the hook in rotational relationship to the body in which the securing means and the body are integral up to the time when the hook is assembled. Thus, there is no danger of lost parts and the single molding operation by which the hanger body is made produces both the hanger body and the collar or anchor mechanism. Further, the cost of the hanger body is not increased but at the same time the labor involved in assembling the hook and hanger body is all but eliminated. Further, the arrangement provides a hook which can freely swivel and, thus, provides a hanger which has a greatly increased utility.

It will be understood that various modifications of this invention can be made without departing from its principles. Such modifications are to be considered as included within the hereinafter appended claims unless these claims, by their language, expressly state otherwise.

The embodiments of the invention in which an exclusive property or privilege is claimed are defined as follows:

1. A molded plastic hanger, said hanger having a molded body, said body having a hook-receiving opening extending vertically into said hanger from the top thereof and means for securing a hook thereto, said means comprising:

an aperture formed in said hanger body aligned with said hook-receiving opening and spaced from the top of said hanger to form a bridge integral with said body between the top of said aperture and the top of said hanger body; said aperture spaced from the bottom of said body to form a second bridgelike portion forming the bottom wall of said aperture; an anchor ring in said opening detachably secured to said hanger body; said anchor ring having an opening therein to receive said hook; said opening being of a size to provide an interference fit with said hook to bind said anchor ring to said hook with sufficient interengagement that force applied to said hook can forcibly detach said anchor ring from said hanger body.

2. The molded plastic hanger described in claim 1 wherein said anchor ring is molded and is connected to said hanger body by a rupturable stem.

3. The molded plastic hanger described in claim 2 wherein said anchor ring and stem are molded simultaneously and integral with said hanger body.

4. The molded plastic hanger described in claim 3 wherein said stem interconnects said ring to the top wall of said aperture.

5. The molded plastic hanger described in claim 3 wherein said stem interconnects said ring to the bottom wall of said aperture.

6. The molded plastic hanger described in claim 2 wherein the vertical thickness of said ring is less than the vertical height of said aperture and the lower face of said ring is spaced from the lower wall of said aperture to facilitate rupture of said stem.

7. The molded plastic hanger described in claim 5 further characterized in that the vertical thickness of the ring is less than the vertical height of said aperture and the upper face of said ring is spaced from the upper wall of said aperture to facilitate rupture of said stem.

8. The molded plastic hanger described in claim 1 wherein said hook-receiving opening has upper and lower portions, one above said aperture and the other below said aperture.

9. A hanger having a molded plastic body and a hook, said hook having a support engaging portion and a shank portion, said body having an opening extending vertically into said hanger from the top thereof for receiving said shank portion of said hook, an aperture formed in said hanger body aligned with said hook-receiving opening and spaced from the top of said hanger, said hanger characterized in that it has an anchor ring in said opening detachably secured to said hanger body; said anchor ring having an opening therein to receive said shank portion of said hook; said opening being of a size to provide an interference fit with said shank portion to bind said anchor ring to said hook with sufficient interengagement that force applied to said hook can forcibly detach said anchor ring from said hanger body.

10. The hanger described in claim 9, further characterized in that the anchor ring is smaller than the aperture and when detached is freely rotatable therein.

11. The hanger described in claim 9 further characterized in that said shank portion has an area of ridge-like projections for penetrating the walls of the opening through said anchor ring to reinforce said interference fit with said ring.

12. The hanger described in claim 10 further characterized in that the shank portion of the hook is circular and of a smaller diameter than the opening through said hanger body whereby it can freely rotate with respect to said hanger body.

13. The hanger described in claim 11 further characterized in that said ridge-like projections are of a greater diameter than the remainder of said shank portion and said remainder of said shank portion is of a diameter to slide through said opening in said anchor ring without appreciable interference.

14. The hanger described in claim 13 further characterized in that the opening in said hanger body above said aperture is of a diameter to permit the passage therethrough of said ridge-like projections.

15. The hanger described in claim 14 further characterized in that said opening has a lower portion extending into said body below said aperture, and said area of ridge-like projections is spaced from the lower end of said shank portion and said lower end of said shank portion extends through said aperture and into said lower portion of said opening.

16. The hanger described in claim 15 further characterized in that the diameter of the lower portion of said opening is the same as that of the opening in said anchor ring.

17. The hanger described in claim 16 further characterized in that said ring is molded simultaneously with said hanger body, a stem of plastic connecting said anchor ring to said hanger body, said stem being a cross-sectional size such that it will rupture in response to the shank of the hook being forced through the anchor ring.

18. The hanger described in claim 17 further characterized in that a pair of said stems are provided, one on each side of said opening to hold said anchor ring against becoming misaligned as said hook is installed.

19. The hanger described in claim 18 wherein said aperture has top and bottom walls and said stems interconnect the top of said anchor ring with the top wall of said aperture; the bottom of said anchor ring being spaced from the bottom wall of said aperture to facilitate rupture of said stems when the shank of said hook is being forced through said anchor ring.

20. The hanger described in claim 19 further characterized in that the hook is formed from metallic wire.

21. The hanger described in claim 19 further characterized in that said stems interconnect the bottom of said anchor ring with the bottom wall of said aperture.

22. Means for securing a hook to a molded plastic hanger, said hanger having a molding body, said body having a hook-receiving opening extending vertically into said hanger from the top thereof, said means comprising:

an aperture formed in said hanger body aligned with said hook-receiving opening and spaced from the top of said hanger; a collar in said opening detachably secured to said hanger body; said collar having an opening therein to receive said hook; said opening being of a size to provide an interference fit with said hook to bind said collar to said hook with sufficient interengagement that force applied to said hook can forcibly detach said collar from said hanger body.

* * * * *